US005176190A

United States Patent [19]

Miyamoto et al.

[11] Patent Number: 5,176,190

[45] Date of Patent: Jan. 5, 1993

[54] AUTOMATIC PLANING MACHINE

[75] Inventors: Kouichi Miyamoto; Mitsumasa Sato; Tatsuya Wada, all of Tokyo, Japan

[73] Assignee: Ryobi Limited, Tokyo, Japan

[21] Appl. No.: 752,075

[22] Filed: Aug. 29, 1991

[30] Foreign Application Priority Data

Aug. 30, 1990 [JP] Japan ..... 2-91421[U]
Sep. 4, 1990 [JP] Japan ..... 2-92917[U]
Sep. 4, 1990 [JP] Japan ..... 2-233957

[51] Int. Cl.[5] ..... B27C 1/02

[52] U.S. Cl. ..... 144/117 R; 144/114 R; 144/246 R; 144/247; 144/249 R

[58] Field of Search ..... 144/114 R, 128, 129, 144/130, 131, 246 R, 247, 246 D, 249 R; 198/624, 817, 836

[56] References Cited

U.S. PATENT DOCUMENTS 3,718,168 2/1973 Berends ..... 144/117 R
3,873,776 2/1954 Buttke ..... 144/117 R
4,031,932 6/1977 Leasure ..... 144/117 R
4,067,370 1/1978 Chang ..... 144/117 R
4,456,042 6/1984 Clark et al. ..... 144/117 R
4,886,099 12/1989 de Abreu ..... 144/117 R

*Primary Examiner*—W. Donald Bray
*Attorney, Agent, or Firm*—Brooks & Kushman

[57] ABSTRACT

An automatic planing machine has two feed rollers on one side of the machine and a stool for holding two pressure rollers which are pressed toward the feed rollers with a pressure force smaller than a pressure force of the feed rollers. The machine has a compact driving mechanism for rotating the feed rollers and further has a feed mechanism for move the stool and a casing for holding the feed rollers toward and away from each together with back-lash preventing means.

11 Claims, 15 Drawing Sheets

AUTOMATIC PLANING MACHINE

BACKGROUND OF THE INVENTION

This invention relates to an automatic planing machine particularly being capable of eliminating backlash during a feeding operation and carrying out a thickness determination work for a workpiece with high precision, and including a simplified driving mechanism, and more particularly to an automatic wood planing machine for cutting a wood workpiece.

An automatic planing machine is generally provided with a cutter block disposed above a table or stool, and a plurality of feed rollers for feeding a workpiece are disposed at the front and rear sides thereof. The workpiece such as wood is automatically fed by the feed rollers along the table and the workpiece is cut during this feeding operation. Such an automatic wood planing machine is disclosed, for example, in Japanese Patent Publication No. 20341/1987.

An improved automatic wood planing machine is also disclosed in Japanese Patent Publication No. 25481/1987, in which two auxiliary rollers are arranged on the side of the table in a manner opposing to the feed rollers. The feed rollers press the workpiece against the auxiliary rollers, whereby the workpiece can be fed with the workpiece clamped between these rollers. Furthermore, the automatic wood planing machine has a roller case for the feed rollers which is moved towards or away from the stool so as to set dimensions of the workpiece. The roller case is always urged by a long compression coil spring in a direction that the roller case is apart from the table to precisely set the dimensions of the workpiece. In addition, the driving system of the automatic wood planing machine comprises a motor having a a driving shaft having an end to which a pulley is secured to thereby transmit the rotation of the motor driving shaft to the cutter block by means of a belt. A speed reduction mechanism is mounted on the extension of the driving shaft of the speed reduction mechanism is transmitted to the feed rollers by means of chains.

However, in one aspect of such a conventional automatic wood planing machine of the characters described above, as shown in FIGS. 17 and 18, a front and a rear auxially rollers 102*a*, 102*b* are rotatably supported by a plurality of bearings which are simply fixed to a stool 103 and which are not urged toward a front and a rear feed rollers 101*a* and 101*b*. At the beginning of work or finishing for a workpiece A, as shown in FIG. 17, the workpiece A is strongly pushed by the front feed roller 101*a* toward the front auxially roller 102*a* with the workpiece A being not pushed by the front feed roller 101*b*. At the end of work, the workpiece A is pushed by the rear feed roller 101*b* toward the rear auxially roller 102*b* with the workpiece A being not pushed by the front feed roller 101*a*. Therefore, the front and rear portions of the workpiece A are deformed upwardly, so that those portions thereof are cut deeply by a cutter block 104 to form two thin portions $a_1$ and $a_2$ on the workpiece A. Further, since the auxially rollers 102*a* and 102*b* or pressure rollers are slightly projected from the guide surface of the stool 103, when a thickness determination work for setting a thickness of the workpiece A is performed, precision of thickness is decreased.

In another aspect of the conventional automatic planing machine, when the long compression coil spring is utilized, the spring force changes according to the size of the gap between the roller case and the table, which results in that the dimension setting stability cannot be maintained.

In still another aspect of the conventional automatic wood planing machine, in the driving mechanism thereof, since the speed reduction mechanism is mounted at a portion apart from the driving motor, the automatic wood planing machine becomes bulky. Further, since the output shaft of the speed reduction mechanism is connected to the feed rollers via a chain, precision in a thickness determination work for the workpiece is degraded.

SUMMARY OF THE INVENTION

An object of this invention is to provide an automatic planing machine capable of cutting a workpiece uniformly flatly and of effectively carrying out a thickness determination work for the workpiece to be cut.

Another object of this invention is to provide an automatic planing machine capable of maintaining constant a force to be applied to a feed roller in spite of a location of the feed roller.

A further object of this invention is to provide automatic planing machine capable of providing a driving mechanism therefore having a simplified structure.

According to one aspect of this invention, there is provided an automatic planing machine for cutting a workpiece, which comprises: a cutter block for cutting the workpiece on one side of the machine; at least one feed roller on a side of the cutter block for feeding the workpiece in one direction; a stool or table disposed opposite to the cutter block for guiding the workpiece; and at least one pressure member disposed opposite to the feed roller so as to project from and retract into the stool, the pressure member pushing the workpiece toward the feed roller with a pressure force smaller than a pressure force generated by the feed roller for pressing the workpiece onto the stool.

According to another aspect of this invention, there is provided an automatic planing machine for cutting a workpiece, which comprises: a cutter block for cutting the workpiece on one side of the machine; at least one feed roller on a side of the cutter block for feeding the workpiece in one direction; a stool or table disposed opposite to the cutter block for guiding the workpiece; and a driving mechanism for rotating the feed roller comprising a power source, a driving force transmission member disposed between an output shaft of the power source and the cutter block for transmitting the driving force of the power source to the cutter block, a reduction gear train disposed between the cutter block and the feed roller for transmitting rotation of the cutter block to the feed roller and a gear case for accommodating the reduction gear train therein.

According to still another aspect of this invention, there is provided an automatic planing machine for cutting a workpiece, which comprises: a cutter block for cutting the workpiece on one side of the machine; at least one feed roller on a side of the cutter block for feeding the workpiece in one direction; a stool or table disposed opposite to the cutter block for guiding the workpiece; at least one feed screw for moving the stool and a casing for holding the feed roller toward and away from each other, one of the stool and the casing being fixed to a base, the other thereof being capable of moving; at least one plate spring disposed between the casing and the feed screw for eliminating a back-lash; and at least one nut disposed between the stool and the feed screw for eliminating the back-lash.

Further objects, features and other aspects of this invention will be understood from the following detailed description of the preferred embodiments of this invention with reference to the drawings.

BRIEF DESCRIPTION OF THE DRAWINGS

For a better understanding of the present invention and to show how the same is carried out, reference is first made, by way of preferred embodiments, to the accompanying drawings, in which.

DESCRIPTION OF THE PREFERRED EMBODIMENTS

One preferred embodiment of an automatic planing machine will be described with reference to the accompanying drawings.

Figure 1:
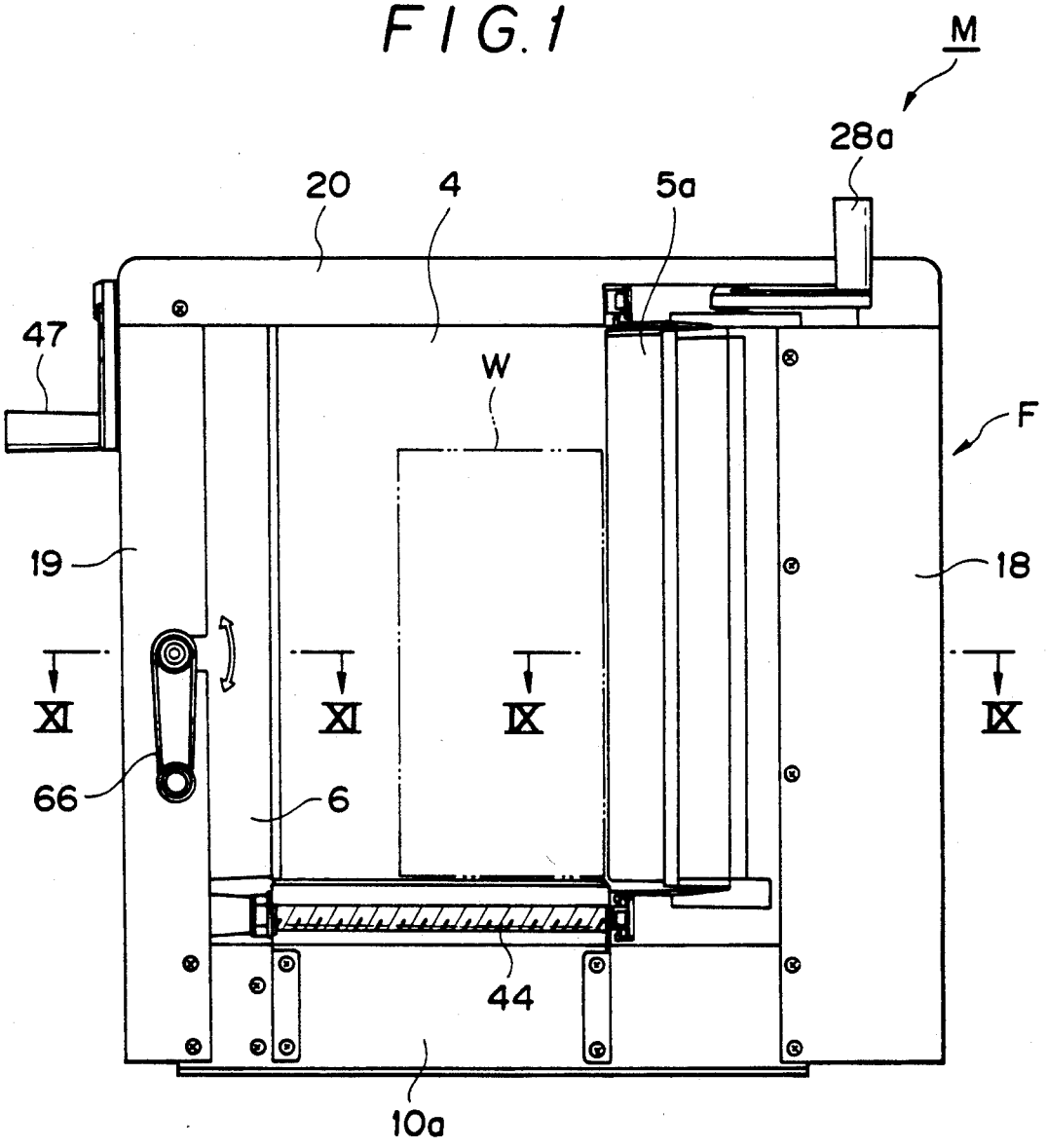
FIG. 1 is a front view of an automatic planing machine according to this invention.
Figure 2:
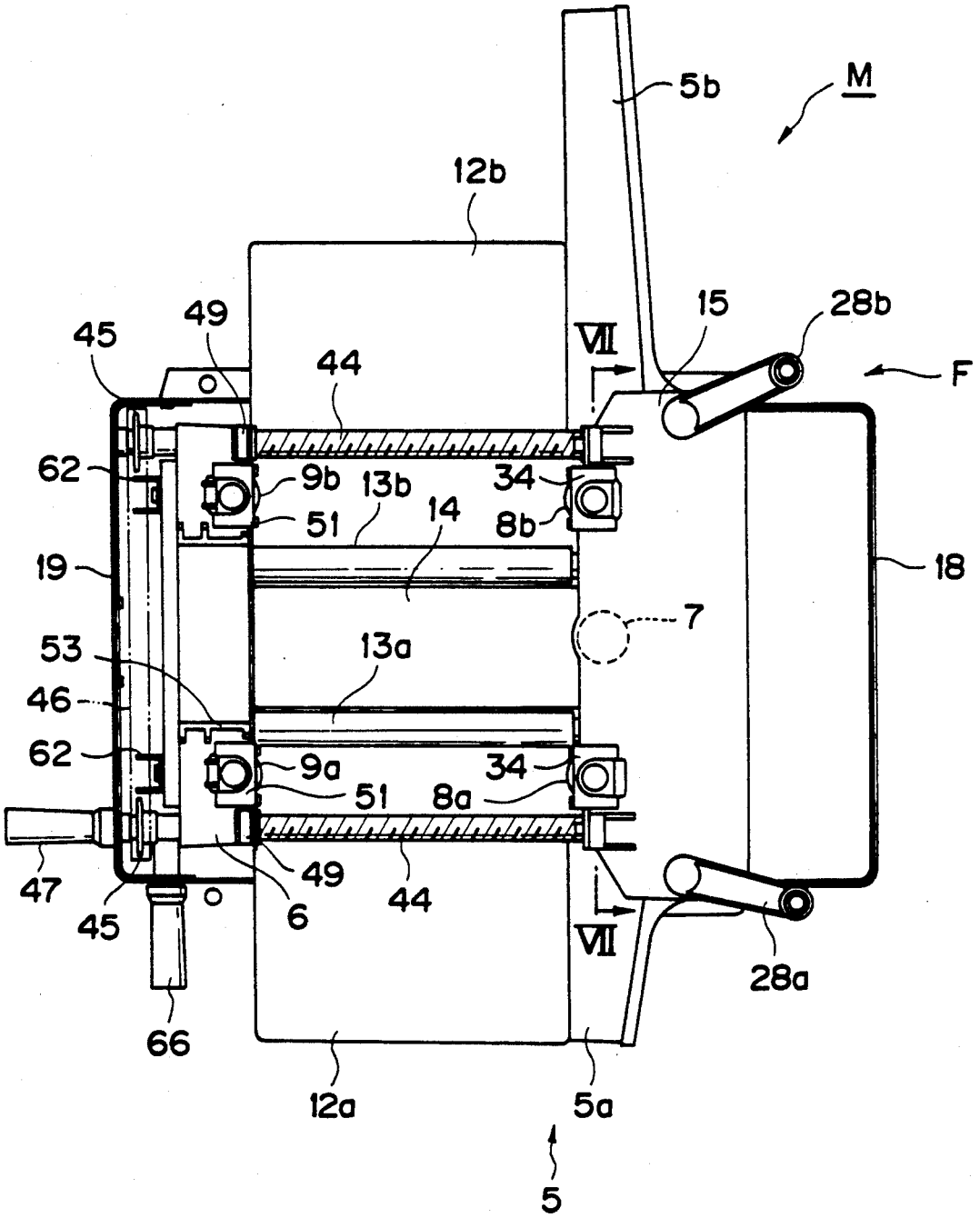
FIG. 2 is a plan view of the automatic planing machine of FIG. 1 with an upper cover removed.
Figure 3:
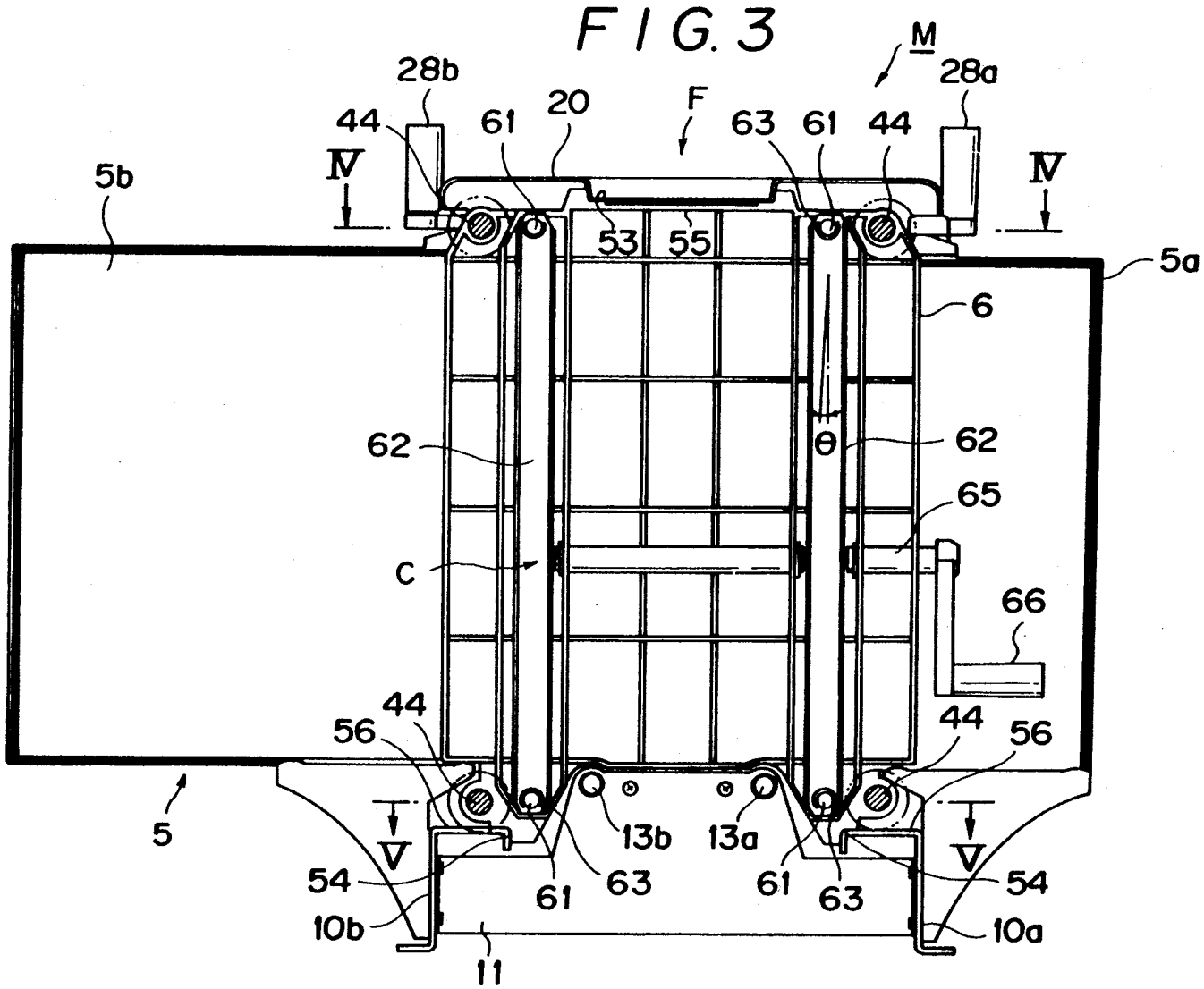
FIG. 3 is a side view of the machine of FIG. 1 with a left cover removed.

Referring first to FIGS. 1 to 3, an automatic planing machine M is provided with a frame F, at the central portion of which is formed a passing hole 4, penetrating in back and forth direction, through which a workpiece W such as wood passes.

A stationary stool or table 5 for carrying out a flat work for the workpiece W is mounted in a vertical arrangement of a right upright portion of the frame F, and a movable stool or table 6 or base plate, opposing to the stationary stool 5, for performing a thickness determination work for the workpiece W is mounted in a left upright portion of the frame F.

A cutter block 7 for cutting the workpiece W is mounted in a vertical arrangement at substantially the central portion of the stationary stool 5 and two feed rollers 8*a* and 8*b* for feeding the workpiece W in one direction are arranged at the front and rear portions of the cutter block 7. Pressure rollers 9*a* and 9*b* are also arranged so as to be oppose to the feed rollers to clamp the workpiece W in association with the feed rollers 8*a* and 8*b*. A pushing device for urging the press rollers 9*a* and 9*b* toward the feed rollers 8*a* and 8*b* is also arranged.

The automatic planing machine is further provided with a feed mechanism for moving the movable stool 6 towards or away from the cutter block 7 and also provided with a driving mechanism for rotating the cutter block 7 and the like, both mechanisms being arranged at the lower portion of the frame.

These mechanisms and members will be described in more detail hereunder.

FRAME

The frame F is provided, at the central portion thereof as described above, with the passing hole 4 through which the workpiece W passes, and accordingly, the frame F has a rectangular cylinder or tube shape in a horizontally laid state. As shown in FIGS. 1 to 3, the frame F has a base composed of a front base portion 10*a* and a rear base portion 10*b* which are interconnected by means of two brackets 11 extending in the back and forth direction. To the front and rear base portions 10*a* and 10*b* are connected two horizontal guide plates 12*a* and 12*b*, respectively, for supporting the workpiece W, and between the bilateral brackets 11 and 11 are disposed two feed rollers 13*a* and 13*b* and a receptacle table 14 for the workpiece W.

Figure 8:
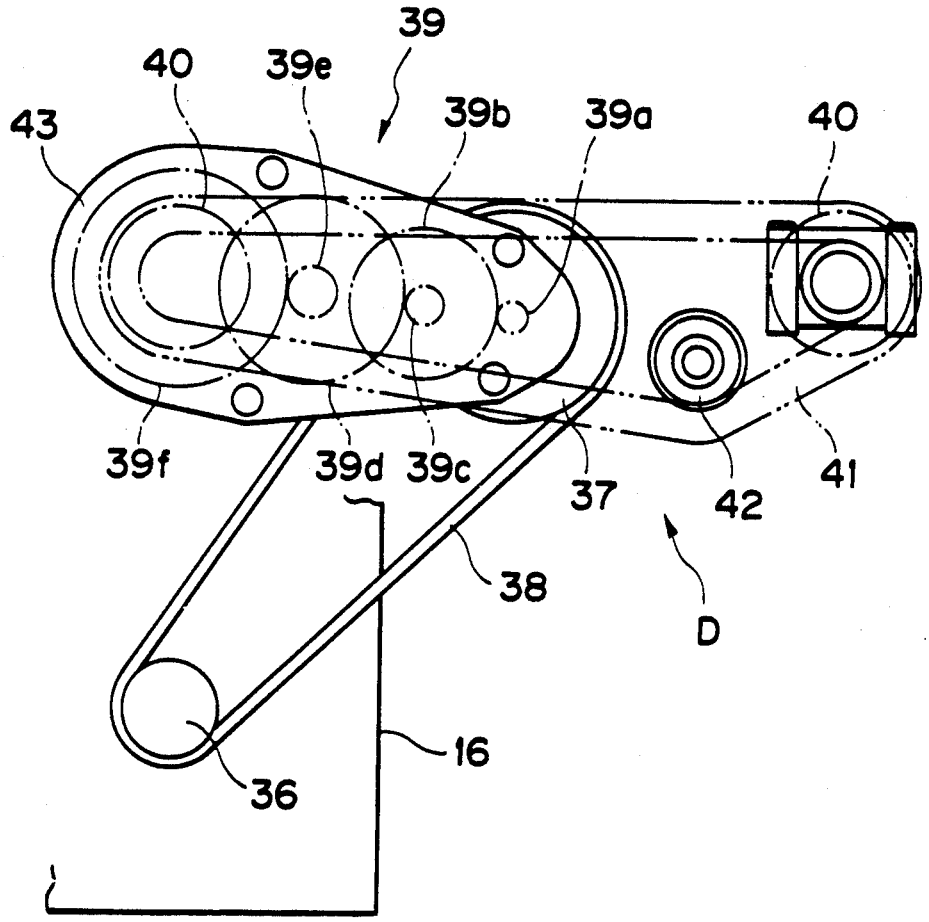
FIG. 8 is a bottom view of the driving mechanism of FIG. 7.
Figure 9:
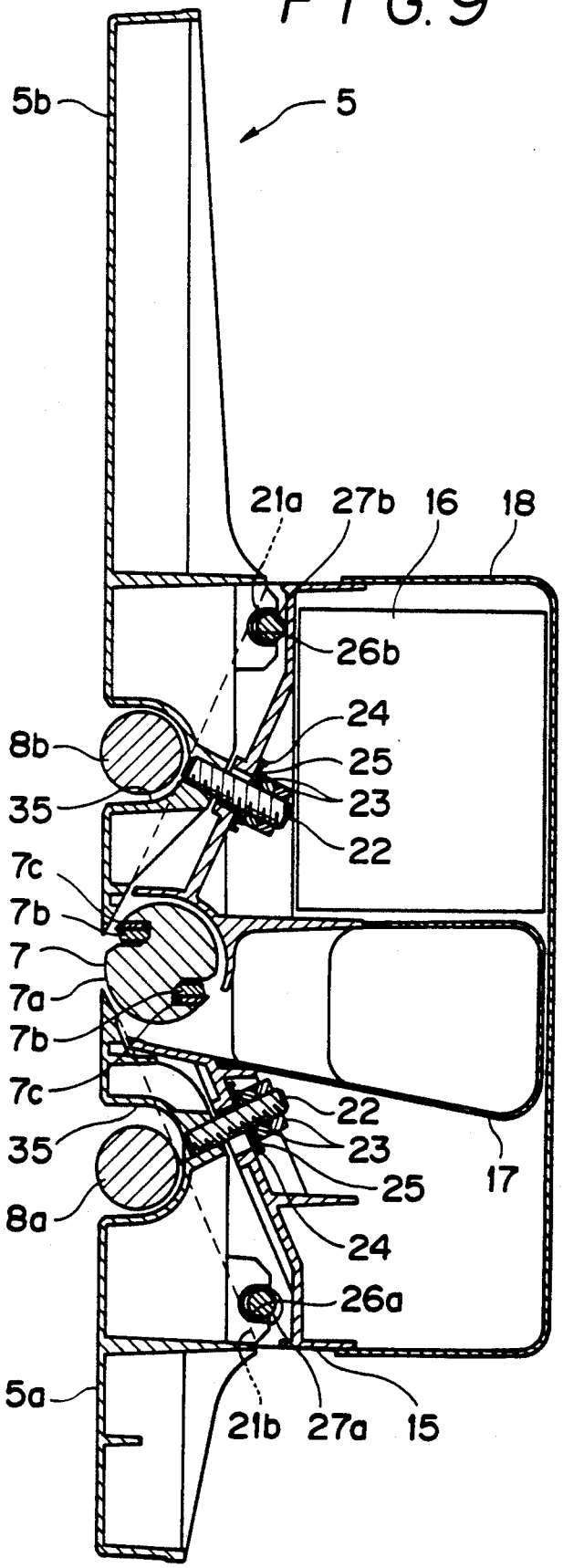
FIG. 9 is a sectional view taken along the line IX—IX in FIG. 1.
Figure 10:
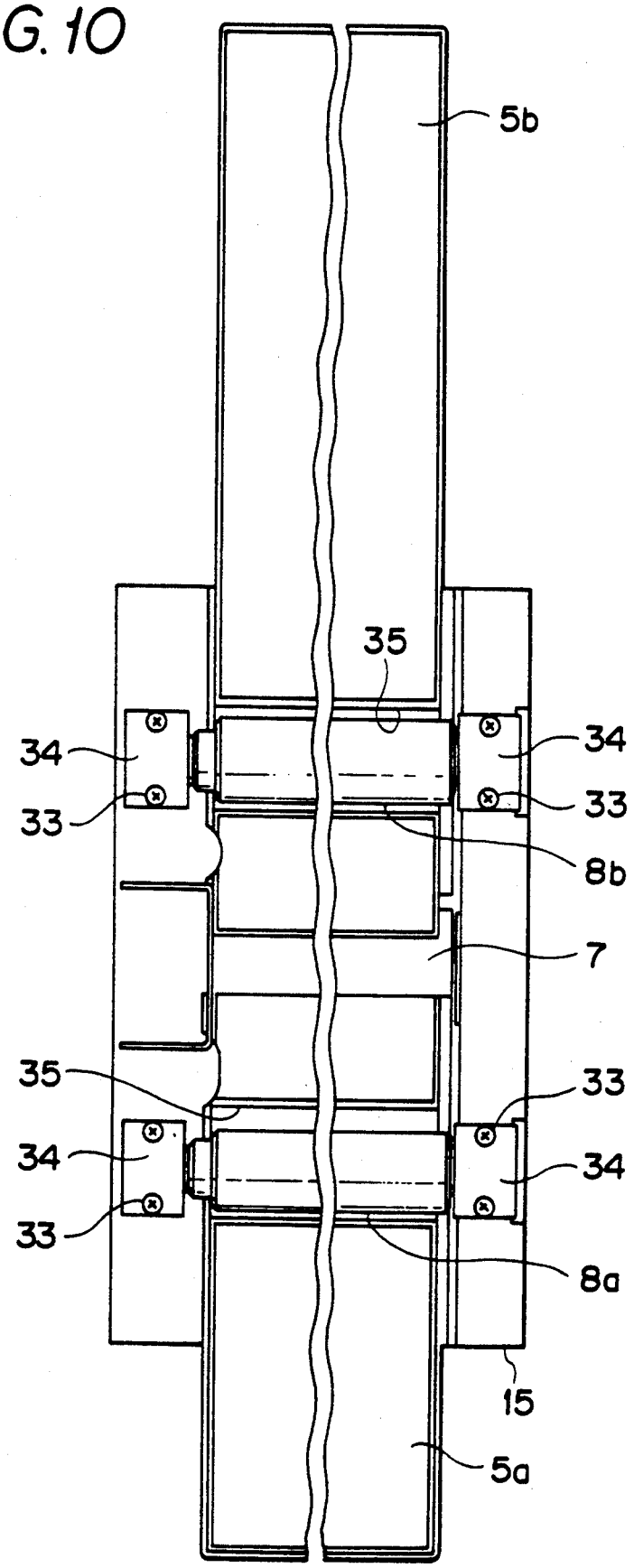
FIG. 10 is a side view, partially broken away, of a stationary stool of FIG. 9.

The main part of the right upright portion raising from the right side of the lower portion of the frame F is composed of, as shown in FIGS. 9 and 10, the cutter block 7 and a roller casing 15 for the feed rollers 8*a* and 8*b*. The casing 15 fastened by means of bolts to the front and rear bases 10*a* and 10*b*. To the central portion thereof on the side of the workpiece passing hole 4 is formed an accommodation chamber for the cutter block 7. A motor 16 (FIG. 8) for driving the cutter block 7, a dust cover 17 for receiving cut chips and others are secured to the opposing side of the hole 4. These elements or members are covered with a right cover 18.

The left upright portion raising from the left side of the base is provided with a left cover 19 detachably connected to the front and rear bases 10*a* and 10*b*.

The upper portions of these bilateral upright portions are operatively connected through an upper cover 20 constituting an upper portion of the frame F.

STATIONARY STOOL

As shown in FIGS. 1 to 3, 9 and 10, a front stool 5*a* and a rear stool 5*b*, as a stationary stool 5, are disposed at the front and rear portions of the location of the cutter block 7 in the roller casing 15 of the frame F.

The front and rear stools 5*a* and 5*b* are disposed to be adjustable in their positions in the back and forth directions and abut against the casing 15 through two inclined surfaces 21*a* and 21*b* inclined at a predetermined angle with respect to the back and forth direction. In this state, each of the front and rear stools 5*a* and 5*b* is held by means of a stud bolt 22, a nut 23, a slide plate 24 and a washer 25. The front and rear stools 5*a* and 5*b* are provided with two U-shaped grooves 26*a* and 26*b*, respectively, at portions facing the casing 15. To the U-shaped grooves 26*a* and 26*b* are fitted two eccentric shafts 27*a* and 27*b*, which are rotated by two handles 28*a* and 28*b*, respectively, pivotted by the casing 15.

According to these structures, when the handles 28*a* and 28*b* are rotated, the eccentric shafts 27*a* and 27*b* are then rotated in the U-shaped grooves 26*a* and 26*b* to thereby move the respective stools 5*a* and 5*b* along the inclined surfaces 21*a*, 21*b*, thus adjusting a cutting amount of the workpiece by means of the cutter block 7.

CUTTER BLOCK, FEED ROLLERS AND DRIVING MECHANISM THEREFOR

Figure 7:
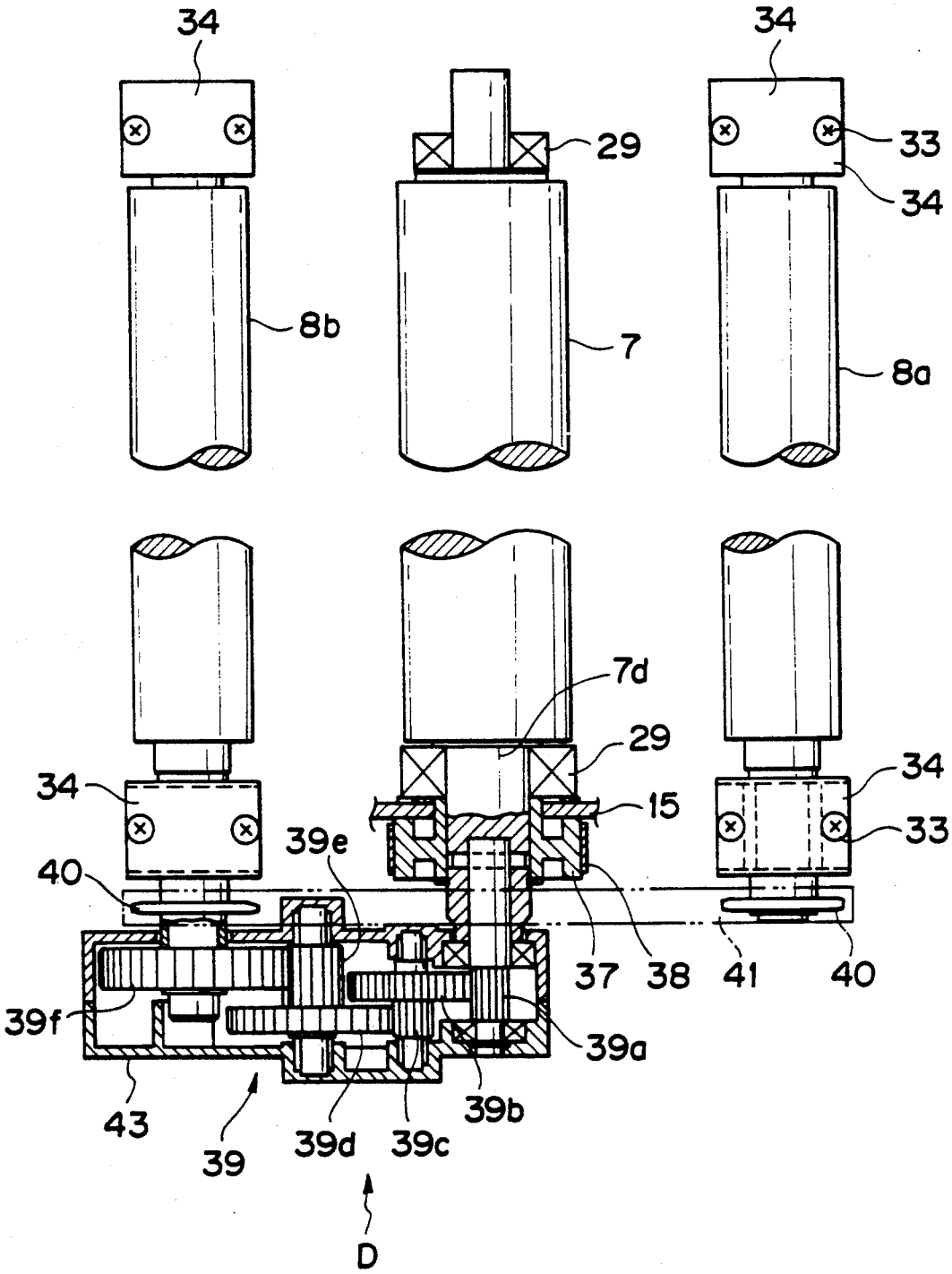
FIG. 7 is a sectional view taken along the line VII—VII in FIG. 2, showing a driving mechanism including a cutter block of the automatic planing machine.

The cutter block 7 is arranged in the casing 15 of the frame F in the vertical arrangement to cut the workpiece W passing through the hole 4 of the frame F, and as shown in FIG. 7, the cutter block 7 is supported in a pivotal manner on the casing 15 through two bearings 29 and 29. As shown in FIG. 9, the cutter block 7 is composed of a columnar block body 7*a* and two cutting blades 7*c* and 7*c* detachably embedded in the block body 7*a* by two cutter support members 7*b* and 7*b*.

Figure 4:
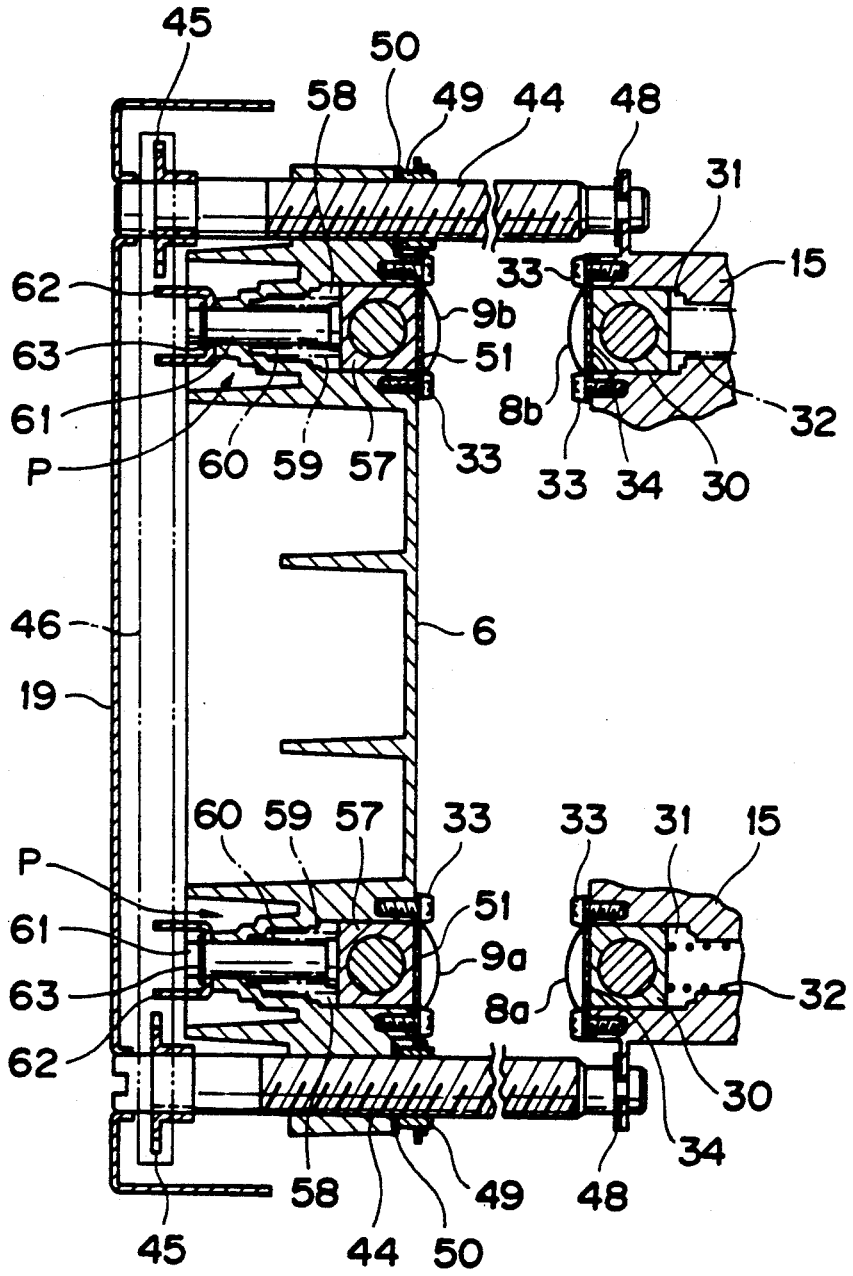
FIG. 4 is a sectional view taken along the line IV—IV in FIG. 3.
Figure 5:
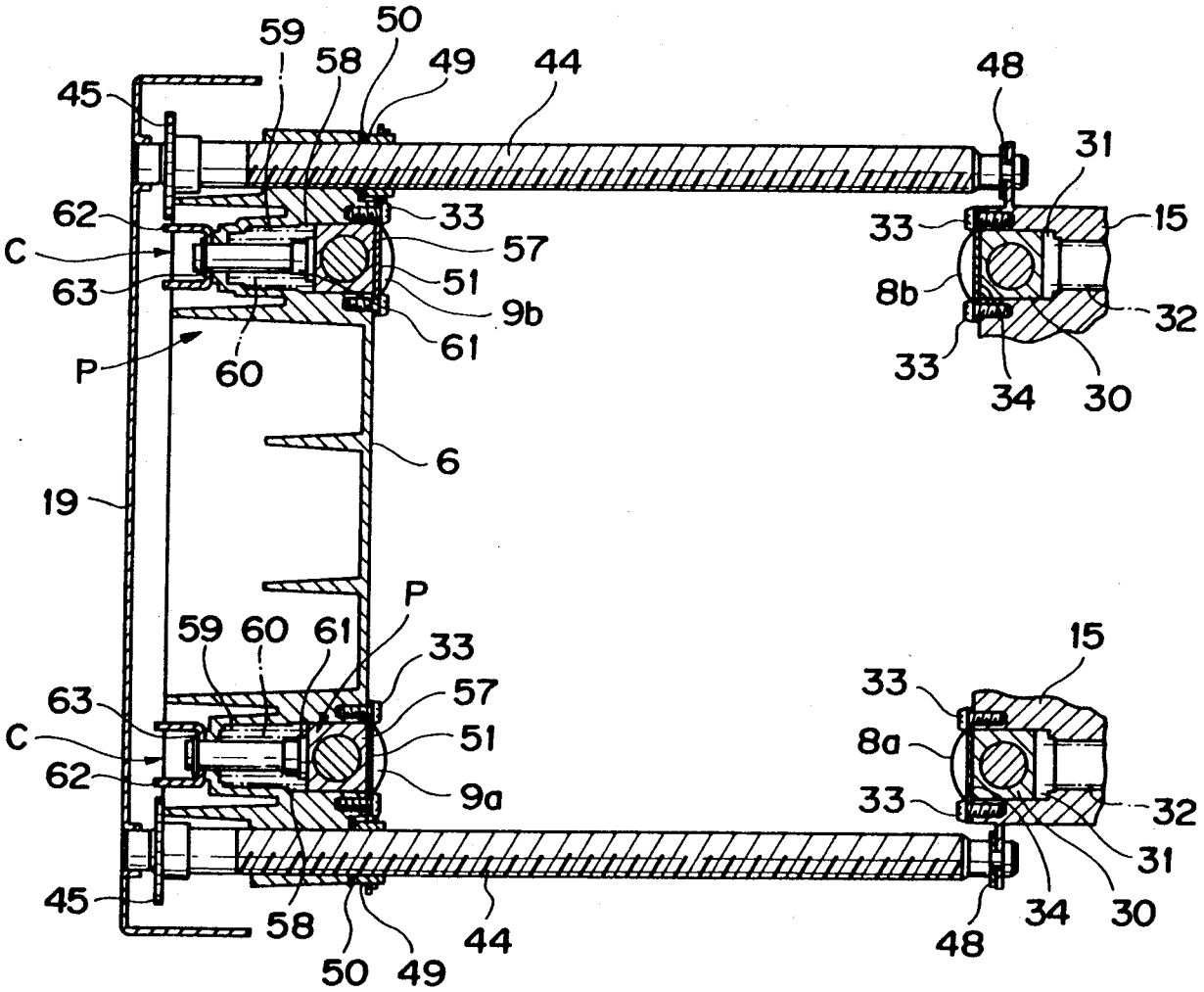
FIG. 5 is also a sectional view taken along the line V—V in FIG. 3.

As shown in FIGS. 2 or 9, the feed rollers 8*a* and 8*b* for feeding the workpiece W forward are disposed at the front and rear portions of the cutter block 7 in parallel with a shaft 7*d* (FIG. 7) thereof in a vertical arrangement. Each of the feed rollers 8*a* and 8*b* is attached, as shown in FIGS. 4 or 5, and secured to the casing 15 of the frame F through two square metal bearings 30, 30 disposed on the upper and lower shafts thereof. Each square metal bearing 30 is fitted into a square hole 31 formed horizontally to the casing 15 and urged by a compression spring 32 at the back portion thereof so that the square metal bearing 30 is pressed against a holding plate 34, having substantially U-shape, secured by a screw 33 to the casing 15 so as to close the square hole 31.

According to this structure, the feed rollers 8*a* and 8*b* are supported elastically with respect to the frame F thereby to contact the surface of the workpiece, with a suitable pressure, passing the hole 4 of the frame F.

The square metal bearings 30 and 30 are positioned in the upper and lower portions of the frame F so as not to contact the workpiece. The intermediate portions of the feed rollers 8*a* and 8*b* are fitted in recessed grooves 35 and 35 formed at the front and rear stools 5*a* and 5*b*, respectively, as shown in FIGS. 9 and 10.

The cutter block 7 and the feed rollers 8*a* and 8*b* described above will be driven by a driving mechanism D shown in FIGS. 7 and 8.

Referring to FIGS. 7 and 8, onto the output shaft of the motor 16 as a power source is mounted a pulley 36 of small size, and the rotation of the output shaft is transmitted through an endless belt 38, as a driving force transmission member, stretched around the small pulley 36 and a pulley 37 of large size disposed below the shaft 7*d* of the cutter block 7. The rotation of the shaft 7*d* of the block shaft 7 is then transmitted to the shaft of one feed roller 8*b* through a gear train 39 of the speed reduction mechanism, and the rotation of the shaft of the feed roller 8*b* is thereafter transmitted to a shaft of the other feed roller 8*a* through a plurality of sprockets 40 and a chain 41 as a rotation transmission member. A tension pulley 42 may be disposed for applying tension to the chain 41.

The speed reduction gear train 39 comprises three small gears 39*a*, 39*c* and 39*e* each having a small diameter and three large gears 39*b*, 39*d* and 39*f* each having a large diameter, which are alternately arranged as shown in FIGS. 7 or 8. The rotational speed for cutting the cutter block 7 is reduced through the gear train 39 to the rotational speed for feeding the workpiece W so as to rotate the feed rollers 8*a* and 8*b*. The gear train 39 is enclosed in a gear case 43, which is accommodated as a whole in the base portion of the frame.

The gear case 39 is pivotally connected to the shaft 7*d* of the cutter block 7 and is held by a shaft of the feed roller 8*b* so as not to rotate therearound.

The sprockets 40 mounted to the shafts of the feed rollers 8*a* and 8*b* have the same number of gear tooth, and accordingly, both the feed rollers 8*a* and 8*b* are rotated in the same direction with the same rotational speed.

According to the structure of the driving mechanism, the rotation of the output shaft of the motor 16 is transmitted to the cutter block 7 through the belt 38 and the pulley 37, whereby the cutter block 7 can cut the surface of the workpiece W while rotating at high speed. The rotation of the cutter block 7 is transmitted to one feed roller 8*b* while being reduced in speed through the gear train 39, and the rotation of the feed roller 8*b* is then transmitted to the other feed roller 8*a*, whereby both the feed rollers 8*a* and 8*b* feed the workpiece W with a suitable predetermined speed from the rear side to the front side along the cutter block 7.

As described, since the rotation of the cutter block 7 can be transmitted to the feed rollers 8*a*, 8*b* through the reduction gear train 39, the power transmission mechanism and the reduction mechanism, which are independently disposed in the prior art, can be composed of in one assembly, thus making simple the structure of the planing machine itself.

MOVABLE STOOL AND FEED MECHANISM THEREFOR

The movable stool 6 is disposed, in a vertical location, on the side of the left upright portion of the frame so as to clamp the workpiece W in association with the stationary stools 5*a* and 5*b*.

The movable stool 6 is engaged, at its four corners, with four feed screws 44, 44, 44 and 44 arranged horizontally, which are supported by means of the left, as viewed in FIG. 2, cover 19 and the casing 15 so as to allow them only to be rotated. Four sprockets 45, 45, 45 and 45 are secured to the left cover 19, and one endless chain 46 is disposed around these sprockets 45 so that one feed screw 44 is rotated by a handle 47 which is mounted on the left cover 19 in association with the sprocket 45. Accordingly, the whole feed screws 44 are rotated in the same direction by rotating the handle 47 to thereby move the movable stool 6 towards or away from the stationary stools 5*a* and 5*b*.

Accordingly, regardless of the gap between the stationary stool 5 and the movable stool 6, a pressure force having always the same magnitude is applied to the workpiece through the feed rollers 8*a* and 8*b*, thus the movable stool being smoothly moved with an accurate amount of feeding and hence improving the dimension setting stability.

Since the movable stool 6 acts to perform the thickness determination work for the workpiece W in association with the stationary stools 5*a* and 5*b*, it is necessary to eliminate the backlash of the respective feed screws 44 and hence to remove the deflection of the movable stool 6. For this purpose, the following structure is adapted for the present invention.

Namely, as shown in FIGS. 4 and 5, a plurality of ring-shaped plate springs 48, 48, 48 and 48 for eliminating the backlash are interposed between the casing 15 and the shaft support portions of the respective feed screws 44, 44, 44 and 44, and a plurality of nuts 49, 49, 49 and 49 and a plurality of ring-shaped flat springs 50, 50, 50 and 50 for eliminating the backlash are also interposed between the movable stool 6 and the respective feed screws 44, 44, 44 and 44. Each nut 49 is engaged with a square hole 52 (FIG. 6) formed at the holding plate 51 secured to the movable stool 6 as referred to hereinlater to prevent the nut 49 from rotating. Each of the plate springs 48 and 50 is composed of a ring member formed of an elastic material, and the ring member is cut at a portion whose opposed portions are slightly offset with each other along the center axis thereof in the opposite directions.

In a modification, the plate springs 50 may be eliminated and in such case, the nuts 49 may be arranged so as to contact the surface of the movable stool 6.

According to these structures, the movable stool 6 can be always smoothly moved, thus precisely controlling the feed amount thereof and hence improving the working precision.

In order to further make sure the smooth feeding of the movable stool 6, the following structure may be adopted.

Namely, as shown in FIGS. 2 and 3, a recessed portion 53 acting as a guide groove is formed at the upper central portion of the movable stool 6, and two recessed portions 54 and 54 also acting as guide grooves are formed on both side portions of the movable stool 6. With these recessed portions 53, 54 are engaged a plurality of rail-shaped projections 55, 56 and 56, which are respectively formed at the upper cover 20 of the frame, the front base 10*a* and the rear base 10*b* so as to extend in the left and right directions. According to the provision of these grooves and projections, the movable stool 6 can be smoothly moved bilaterally while guided by the projections 55, 54 and 54. Instead, the grooves may be formed on the frame side and the projections 55, 56 and 56 may be formed on the side of the movable stool 6.

PRESSURE ROLLER AND PUSHING DEVICE THEREFOR

The pressure rollers (auxially roller) 9*a* and 9*b* for clamping the workpiece W in association with the feed rollers 8*a* and 8*b* are disposed in the movable stool 6 in a vertical location so as to oppose to the corresponding feed rollers 8*a* and 8*b*. The respective pressure rollers 9*a* and 9*b* are mounted on the movable stool 6 through a plurality of pushing devices P, each of which generates two kinds of pressure forces with respect to the pressure rollers 9*a* and 9*b*. That is, either a pressure force larger than a force applied by the feed rollers 8*a* and 8*b* for the flat work for the workpiece or a pressure force smaller than that applied force for the thickness determination work is selectively generated by each pushing device P.

Figure 6:
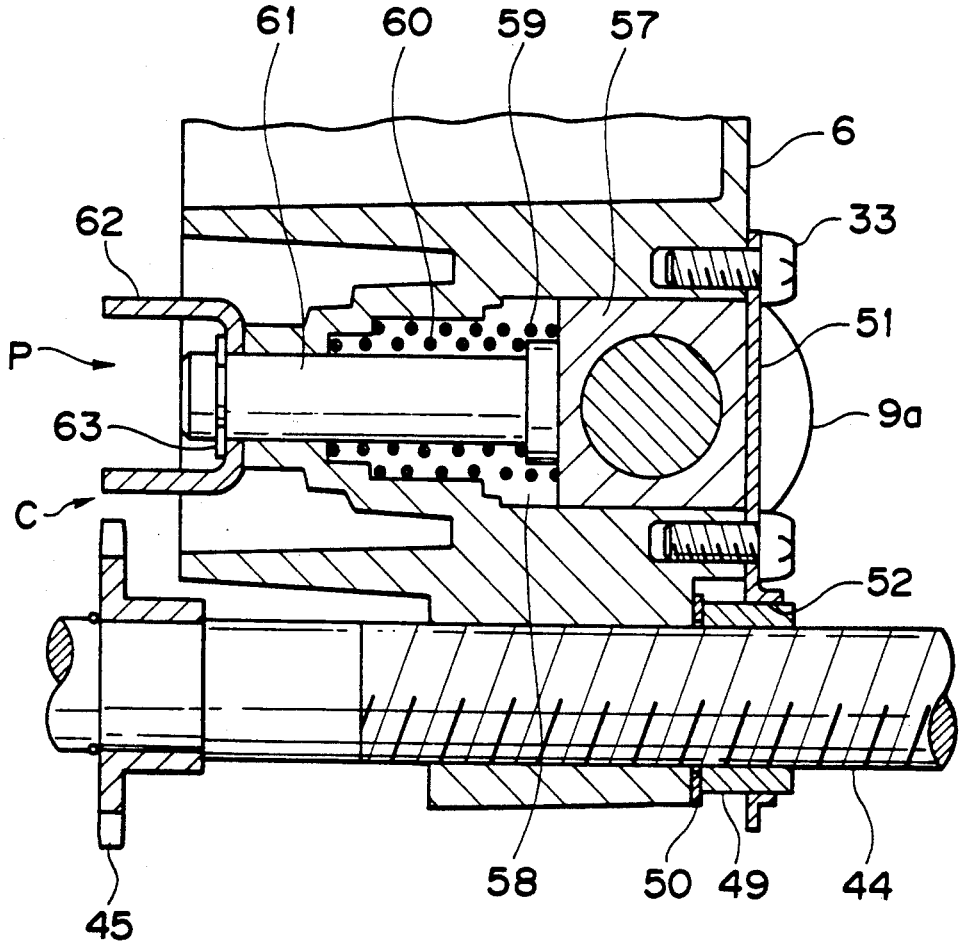
FIG. 6 is a horizontal section, partially broken, of a pushing device for the pressure rollers of the automatic planing machine.

Namely, as shown in FIGS. 4 to 6, the square metal bearing 57, 57, 57 and 57 are mounted on the shaft end portions of the respective rollers 9*a* and 9*b* and fitted in the square holes 58, 58, 58 and 58 formed horizontally to the movable stool 6. The respective square metal bearings 57 are urged by respective first compression springs 59 from the back side thereof and forced against the holding plates 51 secured to the movable stool 6 by a plurality of screws 33 as if the square holes 58 are closed. According to the urging forces of the first compression springs 59, the pressure force for the thickness determination work is applied to the pressure rollers 9*a* and 9*b*. This pressure force is smaller than the pressure force caused by the compression springs 32 for the feed rollers 8*a* and 8*b*.

Within the respective square holes 58, are fitted respective second compression springs 60, 60, 60 and 60 for pressing the corresponding square metal bearings 57, 57, 57 and 57 as well as the first compression springs 59. These second compression springs 60 are arranged for the purpose of generating the pressure force for the flat work by adding another pressure force to the pressure force caused by the first compression springs 59. This pressure force is larger than the pressure force caused by the compression springs 32 for the feed rollers 8*a* and 8*b*.

The second compression springs 60 are operated in an interrupted manner by means of change-over mechanisms C.

Figure 11:
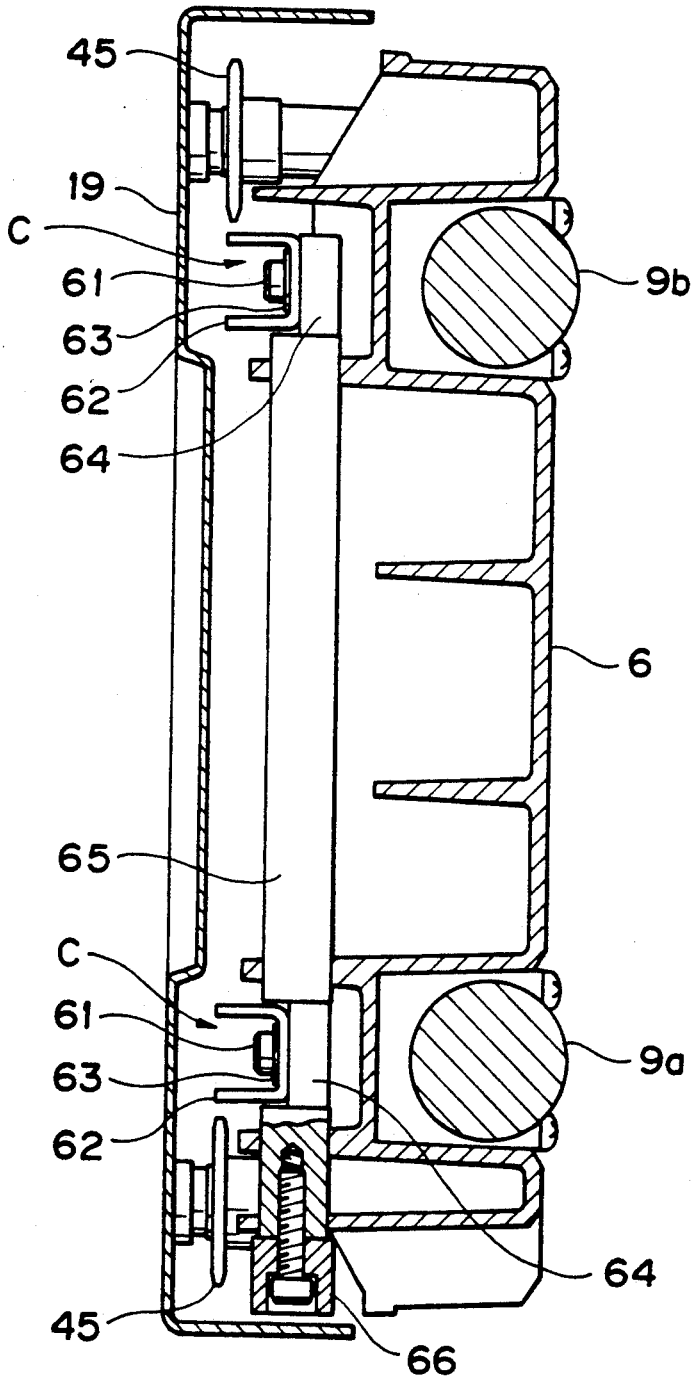
FIG. 11 is a sectional view taken along the line XI—XI in FIG. 1.

As best shown in FIG. 6, each of the change-over mechanisms C includes a pushing pin 61, which is projected into a central space of the compression spring 60 and has a front end engaged with the front portion of the compression spring 60 so as to push the square metal bearing 57 forwardly, that is, rightwardly as viewed in FIG. 6. The rear ends of these pushing pins 61 which are arranged in a vertical direction are connected with each other through an adjusting plate 62 disposed in parallel with the feed rollers 8*a* and 8*b* at the rear portions of the pushing pins 61, and each pin 61 is secured to the adjusting plate 62 by means of a stop ring 63. A cam 64 is arranged so as to abut against the respective adjusting plates 62 from the side of the compression springs, as shown in FIG. 11, and two cams 64 are secured to an operating bar 65 horizontally supported by the movable stool 6 in a pivotal manner. The operating bar 65 is rotated by a handle 66.

According to this structure, when the cams 64 are rotated by rotating the handle 66 at a predetermined angle to take a position shown in FIG. 6, the adjusting plates 62 are moved so that the pushing pins 61 press the square metal bearings 57, whereby the pressure rollers 9*a* and 9*b* are pressed towards the feed rollers by the urging forces of both the first and second compression springs 59 and 60. In this operation, the pressure force of the pressure rollers 9*a* and 9*b* for pressing the workpiece W towards the feed rollers 8*a* and 8*b* exceeds the pressing force caused by the feed rollers 8*a* and 8*b*, whereby the feed rollers 8*a* and 8*b* are retracted to the surface position of the stationary stools 5*a* and 5*b*, and the workpiece W hence contacts the surfaces of the stationary stools 5*a* and 5*b*.

When the cams 64 are further rotated, the second compression springs 60 are shrunk to separate the pushing pins 61 from the square metal bearings 57, whereby the pressure rollers 9*a* and 9*b* are pressed towards the feed rollers 8*a* and 8*b* only by means of the first compression springs 59. In this operation, the pressure force of the pressure rollers 9a and 9b for pressing the workpiece W towards the feed rollers 8a and 8b lowers below the pressure force caused by the feed rollers 8a and 8b, whereby the pressure rollers 9a and 9b are retracted into the movable stool 6 and hence the workpiece W contacts the surface of the movable stool 6.

Figure 12:
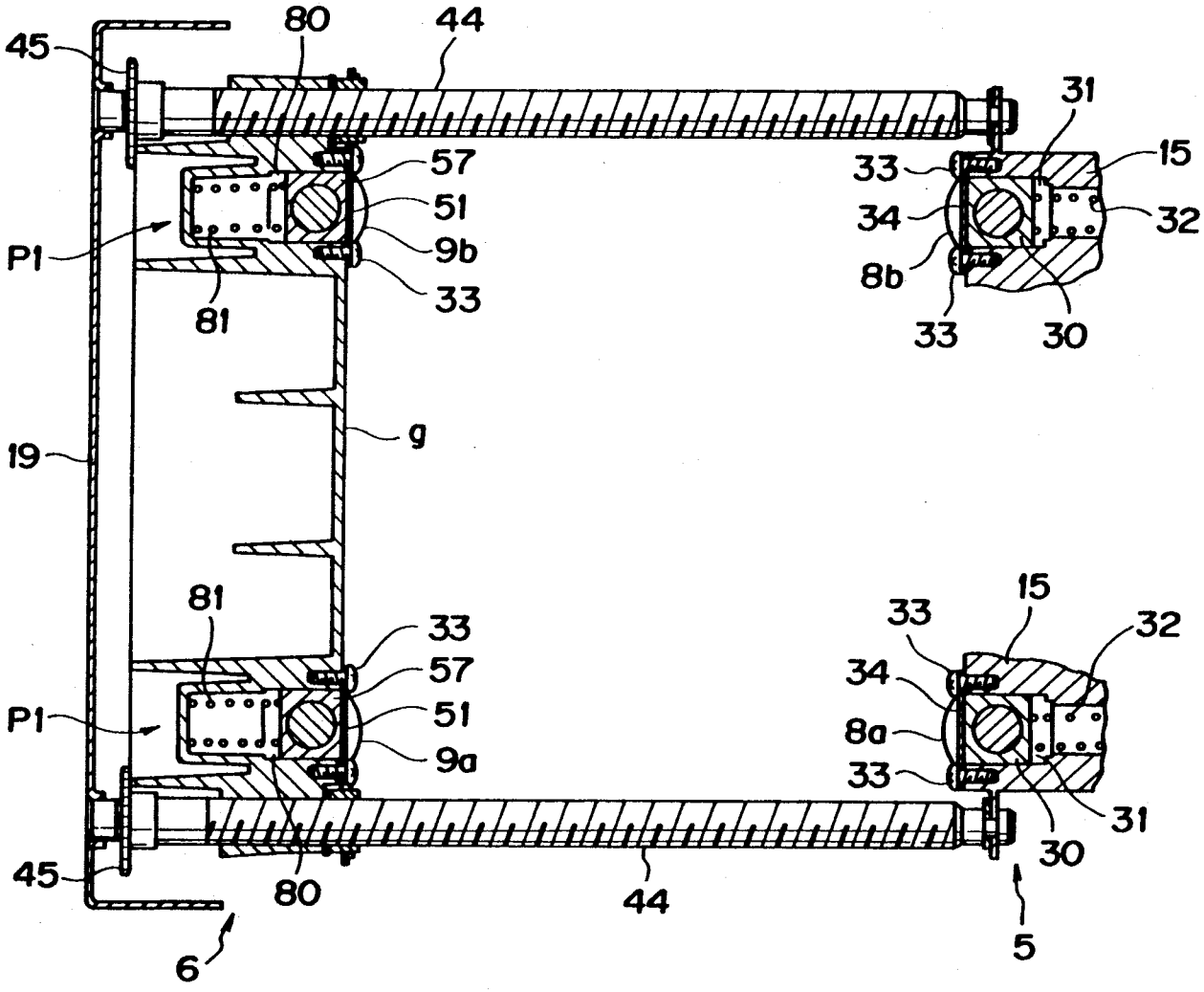
FIG. 12 is a sectional view of one modification corresponding to FIG. 5.
Figure 18:
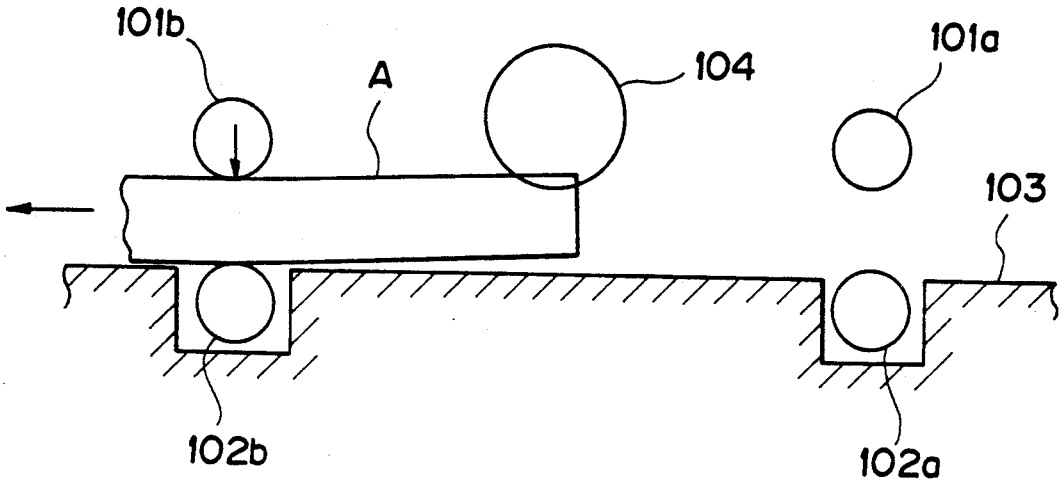
FIG. 18 PRIOR ART
FIG. 18 is an explanatory view showing an operation of the conventional automatic planing machine at the beginning of work.
Figure 19:
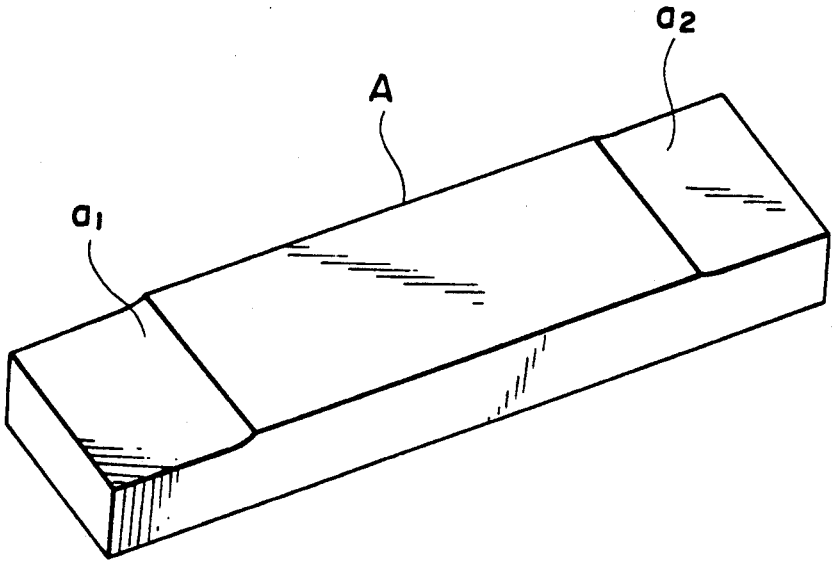
FIG. 19 PRIOR ART
FIG. 19 is a perspective view of a workpiece which is cut by the conventional automatic planing machine.

In the above embodiment, the pressure force for pressing the pressure rollers 9a, 9b is changed over by the provision of the two first and second compression springs 59 and 60. However, in order to avoid the defect the two thin portions are formed at the opposite ends of the workpiece A as shown in FIG. 18, the change-over mechanism C for changing over the pressure force for the feed rollers 9a, 9b is not necessary provided. That is, a pushing device $P_1$ may be constructed as shown in FIG. 12. A pushing device $P_1$ comprises a square hole 80, a compression coil spring 81 accommodated in the square hole 80 and the metal bearing 57 for rotatably holding one of the feed rollers 9a and 9b. The metal bearing 57 is pushed on the holding plate 51 which is held by a plurality of screws 33 on the movable stool 6. A spring force, that is, a pressure force by the compression spring 81 is smaller than that by the compression spring 32 for one of the feed rollers 8a and 8b.

Therefore, when the workpiece A is fed to be cut, the pressure rollers 9a, 9b are retracted into the guide surface g of the movable stool 6 so that the workpiece A contacts the guide surface g of the movable stool 6.

Figure 13:
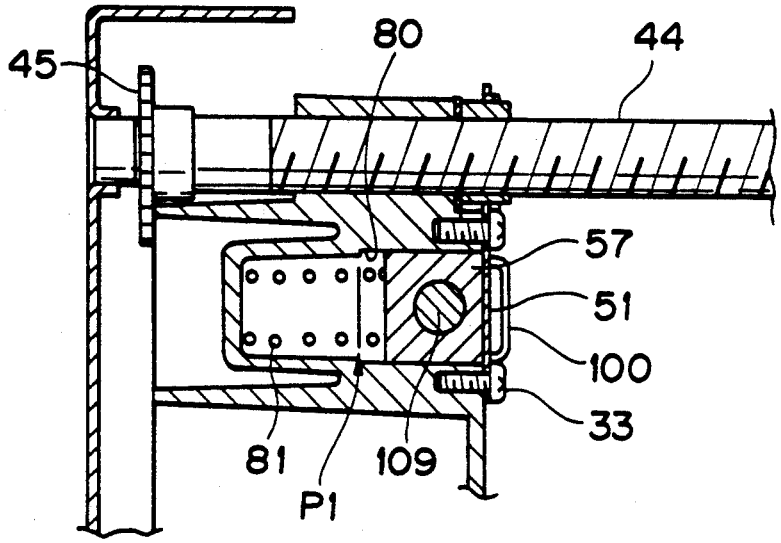
FIG. 13 is a view similar to FIG. 6, showing another modification in which a pressure plate is substituted for the pressure roller.
Figure 14:
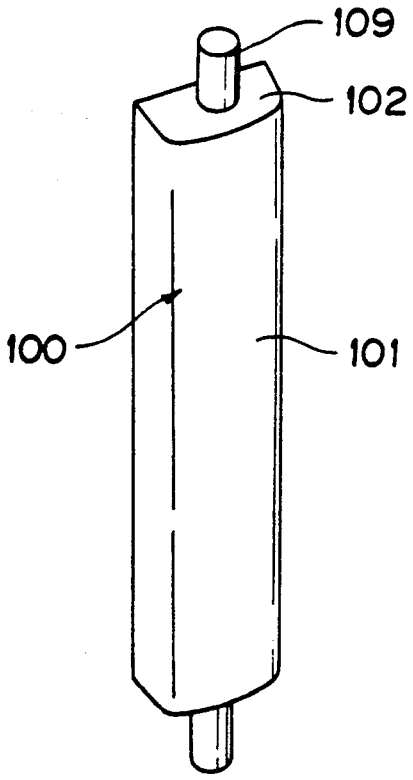
FIG. 14 is a perspective view of the pressure plate of FIG. 13.

Instead of the pressure rollers 9a, 9b, as shown in FIGS. 13 and 14, a holding plate 100 may be utilized as an auxiliary pressure member of the foregoing embodiment. Namely, referring to FIGS. 13 and 14, the holding plate 100 has a body structure having a U-shaped cross section and the body is provided with a flat front portion 101 and both ends of the flat portion are closed by two end plates 102. The end plates 102 are secured to a support shaft 109, which is supported by the pushing device $P_1$ for supporting the pressure rollers 9a and 9b as mentioned for the former embodiment.

The flat and thickness determination works of the automatic planing machine according to this invention will be described, respectively, hereunder.

FLAT WORK

First, the handles 28a and 28b are rotated to adjust the locations of the stationary stools 5a and 5b to position them.

The pushing devices P are then operated by rotating the handle 66 to make the second compression springs 60 contact the square metal bearings.

The movable stool 6 is moved by rotating the handle 47 in conformity with the thickness of the workpiece W, and during this movement, the movable stool 6 can be smoothly guided under the engagement of the recessed grooves 53 and 54 with the projections 55 and 56.

In the next step, the motor 16 is driven thereby to rotate the feed rollers 8a and 8b and the cutter block 7 with constant rotation speeds, respectively, thus feeding the workpiece W. The workpiece W is automatically fed along the back and forth direction of the automatic planing machine by the friction force caused between the feed rollers 8a and 8b and the workpiece W. During this feeding motion, the pressure rollers 9a and 9b press the workpiece W towards the feed rollers 8a and 8b with the pressure force larger than that of the feed rollers 8a and 8b, so that the workpiece A can be cut by the cutter block 7 while contacting the surfaces of the stationary stools 5a and 5b, thus performing the flat work for the workpiece A.

THICKNESS DETERMINATION WORK

The position adjusting operatings of the stationary stools 5a and 5b and the movable stool 6 are substantially the same as those carried out in the flat working operation, but the pushing devices P are reversely operated. Namely, the pushing pins 61 are separated from the square metal bearings 57 to release the pressure force of the compression springs 60. According to this operation, the pressure force by the feed rollers 8a and 8b exceeds the pressure force by the pressure rollers 9a and 9b, so that the pressure rollers 9a and 9b are retracted into the surface of the movable stool 6. Accordingly, the workpiece W is moved contacting the guide surface g of the movable stool 6, thus performing the cutting operation to the opposite surface of the workpiece W.

Figure 15:
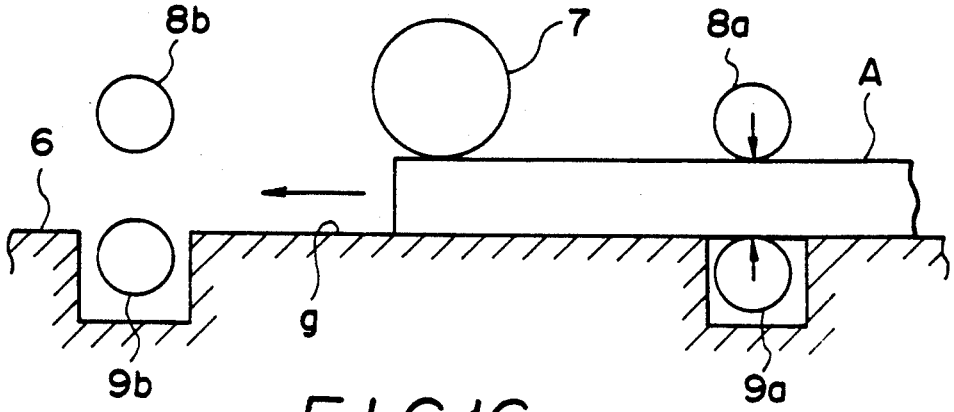
FIG. 15 is an explanatory view showing an operation of the automatic planing machine according to this invention at the beginning of work.
Figure 16:
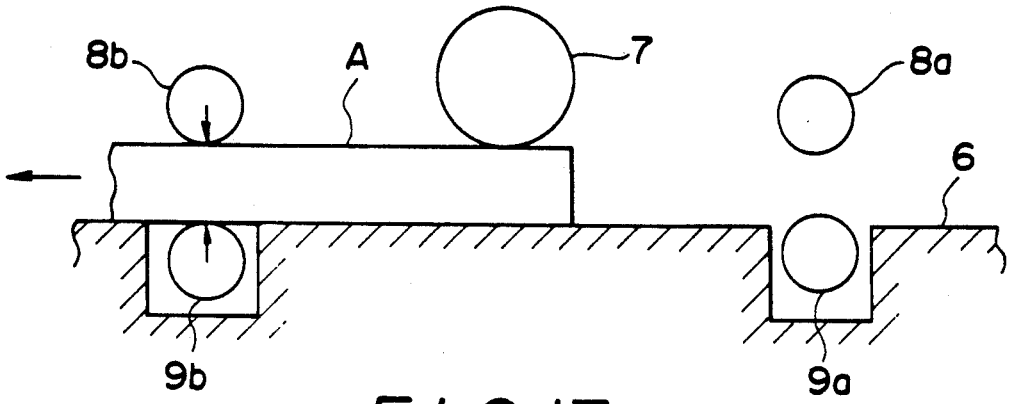
FIG. 16 is an explanatory view showing an operation of the automatic planing machine according to this invention at the end of work.
Figure 17:
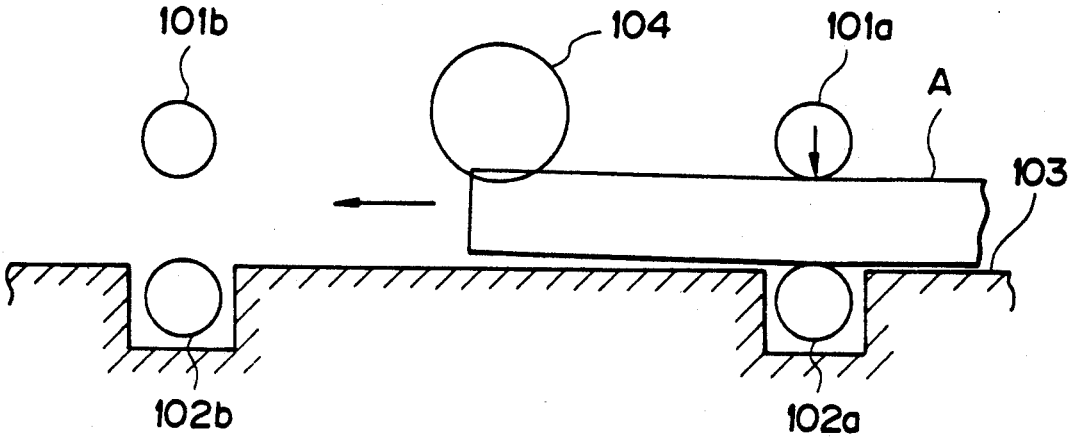
FIG. 17 PRIOR ART
FIG. 17 is an explanatory view showing an operation of a conventional automatic planing machine at the beginning of work.

At this time, as shown in FIGS. 15 and 16, the workpiece A is pushed by both the feed roller 8a and the pressure roller 9a opposed to the feed roller 8a at the beginning of work, and by both the feed roller 8b and the pressure roller 9b at the end of work in the directions opposite to each other. Therefore, the deformation of the opposite ends of the workpiece A as shown in FIGS. 17 and 18 can be effectively avoided to perform an even flat work with an even thickness of the workpiece A. This function can be also performed by the embodiment shown in FIGS. 12 to 14.

The automatic planing machine including the cutter block, the movable stool or base plate and the like arranged in the vertical location, but they may be arranged in the horizontal location. Therefore, the self-gravity of the workpiece is not exerted on the cutter block, which improves the cutting precision of the cutter block.

What is claimed is:

1. An automatic planing machine for cutting a workpiece, which comprises:

a) a cutter block for cutting one side of the workpiece;

b) at least one feed roller located beside the cutter block for feeding the workpiece in one direction;

c) a table disposed opposite to the cutter block for guiding the workpiece; and d) at least one pressure member disposed opposite to the feed roller so as to project from and retract into the table, the pressure member pushing the workpiece toward the feed roller with a pressure force smaller than a pressure force generated by the feed roller for pressing the workpiece onto the table.

2. An automatic planing machine according to claim 1, wherein the cutter block, the feed roller, and the table are disposed vertically, respectively.

3. An automatic planing machine according to claim 1, wherein two feed rollers are provided one located in the front of and one in the rear of the cutter block, and wherein two pressure members are provided one located opposite to each feed roller.

4. An automatic planning machine according to claim 1, wherein the pressure member comprises a pressure roller.

5. An automatic planing machine according to claim 1, wherein the pressure member comprises a pressure plate.

6. An automatic planing machine for cutting a workpiece, which comprises:

a) a cutter block for cutting one side of the of the workpiece;

b) at least one feed roller located beside the cutter block for feeding the workpiece in one direction;

c) a table disposed opposite to the cutter block for guiding the workpiece; and d) a driving mechanism for rotating the feed roller including a power source, a driving force transmission member disposed between the power source and the cutter block for transmitting the driving force of the power source to the cutter block, a reduction gear train disposed between the cutter block and the feed roller for transmitting rotation of the cutter block to the feed roller and a gear case for accommodating the reduction gear train therein.

7. An automatic planing machine according to claim 6 wherein two feed rollers are provided, one located in the front of and one in the rear of the cutter block, the reduction gear train disposed between one of the feed rollers and the cutter block, one of the feed rollers being connected to the other of the feed rollers by a transmission member.

8. An automatic planing machine according to claim 6, wherein said cutter block and said feed roller are each provided with a central shaft pivotably supported by the gear case.

9. An automatic planing machine for cutting a workpiece, which comprises:

a) a cutter block for cutting the workpiece on one side;

b) at least one feed roller located beside the cutter block for feeding the workpiece in one direction;

c) a table disposed opposite to the cutter block for guiding the workpiece;

d) at least one feed screw for moving the table;

e) a casing for holding the feed roller, one of the table and the casing being fixed the other thereof being capable of moving;

f) at least one plate spring disposed between the casing and the feed screw for eliminating back-lash between the casing and the feed screw; and g) at least one nut disposed between the table and the feed screw for eliminating back-lash between the casing and the feed screw.

10. An automatic planing machine according to claim 9, wherein four feed screws are disposed between the casing and the table.

11. An automatic planing machine according to claim 9, wherein at least one plate spring is disposed between the feed screw and the nut.

* * * * *